US006422306B1

(12) United States Patent
Tomlinson et al.

(10) Patent No.: US 6,422,306 B1
(45) Date of Patent: Jul. 23, 2002

(54) HEAT EXCHANGER WITH ENHANCEMENTS

(75) Inventors: Ronald S. Tomlinson, Mt. Juliet, TN (US); Shaobo Jia, Lilburn, GA (US)

(73) Assignee: International Comfort Products Corporation, Lewisburg, TN (US)

( * ) Notice: Subject to any disclaimer, the term of this patent is extended or adjusted under 35 U.S.C. 154(b) by 0 days.

(21) Appl. No.: 09/851,792

(22) Filed: May 9, 2001

Related U.S. Application Data

(60) Provisional application No. 60/236,969, filed on Sep. 29, 2000.

(51) Int. Cl.[7] ..... F28F 13/12; F28F 3/14; F24H 3/00

(52) U.S. Cl. ..... 165/170; 165/109.1; 126/110 R

(58) Field of Search ..... 165/109.1, 170, 165/171, 173, 175, 177, 147; 126/110 R, 126 R; 138/39

(56) References Cited

U.S. PATENT DOCUMENTS

| | | | | |
|---|---|---|---|---|
| 4,298,061 A | | 11/1981 | Hoeffken | |
| 4,441,241 A | | 4/1984 | Hoeffken | |
| 4,467,780 A | * | 8/1984 | Ripka | 126/110 R |
| 4,510,660 A | | 4/1985 | Hoeffken | |
| 4,538,338 A | | 9/1985 | Hoeffken et al. | |
| 4,547,943 A | | 10/1985 | Hoeffken | |
| 4,649,894 A | | 3/1987 | Hoeffken | |
| 4,663,837 A | | 5/1987 | Hoeffken et al. | |
| 4,718,484 A | | 1/1988 | Hoeffken | |
| 4,739,746 A | | 4/1988 | Tomlinson | |
| 4,893,390 A | | 1/1990 | Hoeffken | |
| 4,919,200 A | * | 4/1990 | Glomski et al. | 165/170 |
| 4,982,785 A | | 1/1991 | Tomlinson | |
| 5,094,224 A | | 3/1992 | Diesch | |
| 5,271,376 A | | 12/1993 | Lu et al. | |
| 5,295,473 A | * | 3/1994 | Neufeldt | 126/116 R |
| 5,346,001 A | | 9/1994 | Rieke et al. | |
| 5,359,989 A | | 11/1994 | Chase et al. | |
| 5,408,986 A | | 4/1995 | Bigham | |
| 6,006,741 A | * | 12/1999 | Daddis, Jr. | 126/110 R |
| 6,109,254 A | | 8/2000 | Reinke et al. | |

* cited by examiner

*Primary Examiner*—Henry Bennett
*Assistant Examiner*—Tho V Duong
(74) *Attorney, Agent, or Firm*—Baker & Daniels

(57) ABSTRACT

A heat exchanger for use with a furnace, each heat exchanger includes a plurality of heat exchanger elements. Each heat exchanger element includes a pair of clamshells sealingly attached to one another. The heat exchanger element includes a longitudinal axis. A pair of depressions are disposed in each respective said pair of clamshells. The depressions face one another to form a passageway wall and a serpentine fluid passageway therebetween. At least a portion of the serpentine fluid passageway extends along the longitudinal axis. A plurality of enhancements are formed in the depressions and are disposed within the portion of the serpentine fluid passageway. The plurality of enhancements project into the serpentine fluid passageway. Each enhancement constitutes a corrugation having a substantially trapezoidal longitudinal cross-section. A longitudinally positioned passageway wall portion is extended between each adjacently positioned enhancements within each clamshell.

12 Claims, 7 Drawing Sheets

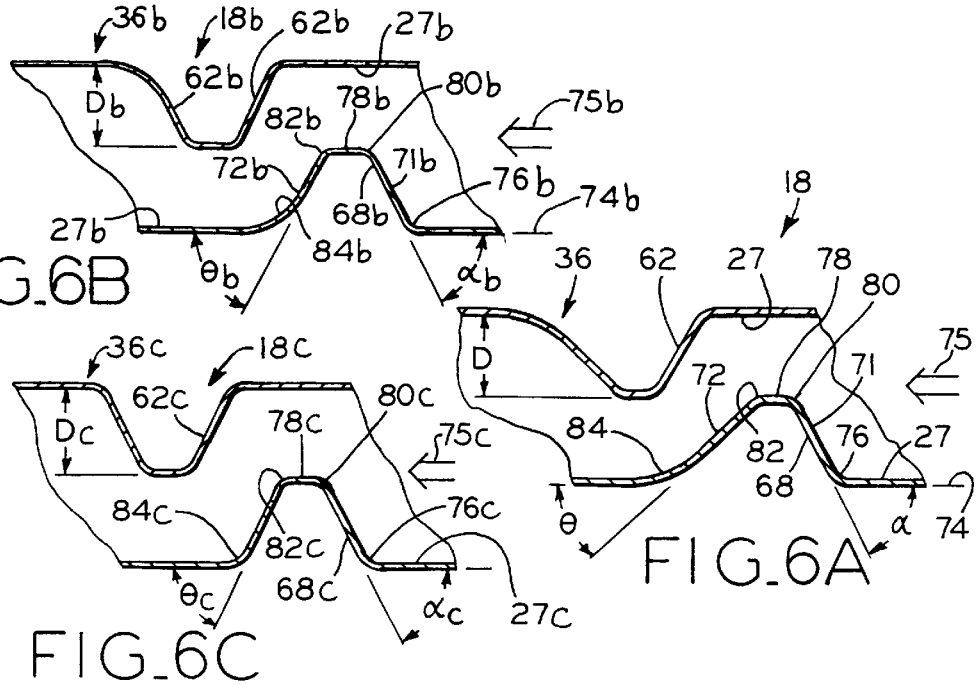
FIG_6B
FIG_6A
FIG_6C
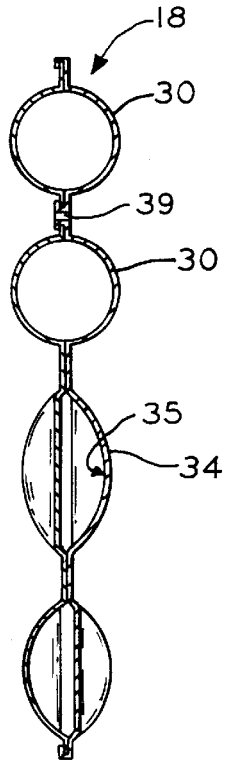
FIG_7
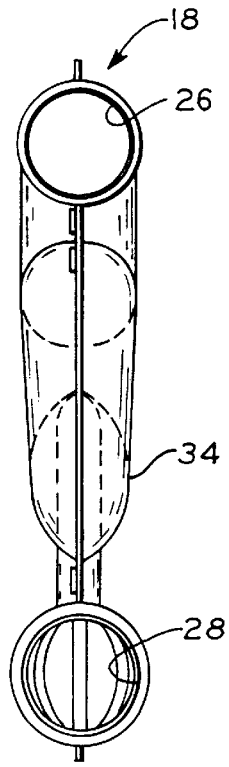
FIG_8

HEAT EXCHANGER WITH ENHANCEMENTS

This application claims priority from Provisional application Ser. No. 60/236,969, filed Sep. 29, 2000.

BACKGROUND OF THE INVENTION

1. Field of the Invention

This invention relates to furnaces and in particular to heat exchangers for use in furnaces.

2. Description of the Related Art

In one form of a conventional domestic furnace, air to be heated is passed in heat transfer association with a plurality of stacked serpentine heat exchanger elements forming a heat exchanger encased in a cabinet. Each heat exchanger element defines a flow path for hot products of combustion produced by combustion of fluid fuel, typically, such fuel may include, for example, oil or natural gas. The hot products of combustion, in passing through the heat exchanger elements, transfer their heat energy to the air to be heated, conventionally referred to as the room air, and are then exhausted through a suitable flue.

Prior art serpentine heat exchangers are typically manufactured from either a continuous tube or in two halves joined together, e.g., "clam-shell", by known bending and/or joining techniques. To increase the heat transfer between the combustion products, contained within the heat exchanger, and the ambient environment residing at the exterior of the same, it is known that forcing the flow to become non-laminar, especially at the latter portion of the exchanger, greatly improves heat transfer.

Flow diverters and separators of many types were added to the interior structure of the exchangers to increase the flow turbulence, however such methods significantly increased manufacturing costs of the heat exchangers. To lessen the expense yet retain acceptable levels of exchanger performance both continuous tube and clamshell type heat exchanger elements included external deformations to create internal flow "turbulators" to increase heat transfer performance at an acceptable additional cost. However, the need has arisen to decrease the size of furnace cabinet and accompanying heat exchanger assembly therein while sustaining equal or increased heat transfer characteristics of the heat exchanger assembly.

U.S. Pat. No. 5,346,001 issued to Rieke et al. discloses a heat exchanger which employs a turbulator region comprised of multiple, interfacing and closely arranged deformations within the clamshells. The deformations are successively and contiguously arranged within each clamshell to promote turbulence, and consequently, enhanced heat transfer within this region. However, the turbulator region causes a significant decrease in flow velocity along portions of the interior walls of the turbulator region which corresponds to a decrease of heat transfer along these wall portions.

A clamshell type heat exchanger assembly which causes turbulent flow, however increases flow velocity at the site of passageway walls to increase heat transfer between the heat exchanger elements and room air would be desirable.

Further, a clamshell type heat exchanger utilizing conventional materials of construction which sealably contains flue gases while using less heat exchanger materials, consequently providing a significant cost decrease, as compared to prior art exchangers, would be desirable.

SUMMARY OF THE INVENTION

The present invention overcomes the disadvantages of prior art furnaces by employing a heat exchanger including a plurality of clamshell elements having trapezoidal enhancements to significantly increase the heat transfer and provide an overall smaller or compact furnace corresponding to a reduction of manufacturing and assembly costs.

The present invention provides a heat exchanger for use with a furnace including a plurality of heat exchanger elements having internal structures which receive hot products of combustion and transfer heat to room air being externally forced over each heat exchanger element. Each heat exchanger element includes a pair of clamshells, having depressions facing one another. The depressions are sealingly clamped to one another and form a passageway wall and a serpentine fluid passageway therebetween. The depressions within the clamshells define an inlet and an outlet in fluid communication through the serpentine flow passageway. A plurality of enhancements are disposed within the depressions defined in the clamshells and extend into the flow passageway. Each enhancement is provided with a corrugation and each corrugation includes a substantially trapezoidal cross-section. Longitudinally positioned passageway wall portions extend between adjacently positioned enhancements within each clamshell. The plurality of enhancements are structured and arranged with the passageway wall portions to direct a flow of products of combustion received in the heat exchanger element along the passageway wall at a non-zero velocity.

The present invention heat exchanger, in one form thereof, includes a heat exchanger element having enhancements in one clamshell coacting with enhancements in the other clamshell to increase the heat transfer between the flow of hot products of combustion through the element with room air flowing externally over the element. Each enhancement defines upstream and downstream ramping portions separated by a plateau and having respective angles of inclination and declination.

The heat exchanger of the present invention further provides at least one heat exchanger element having a pair of clamshells. The clamshells include a serpentine fluid passageway therein which receives hot products of combustion. The fluid passageway includes an inlet channel and at least one enhancement channel positioned downstream relative to the inlet channel. The inlet and enhancement channels are in fluid communication with one another and a plurality of enhancements are disposed within the enhancement channel. The enhancements reduce zones of recirculation formed by the hot products flowed through the passageway and correspondingly increase the heat transfer between the hot products of combustion and room air being urged externally over the heat exchanger element.

BRIEF DESCRIPTION OF THE DRAWINGS

The above-mentioned and other features and advantages of the present invention, and the manner of attaining them, will become more apparent and the invention will be better understood by reference to the following description of embodiments of the invention taken in conjunction with the accompanying drawings, wherein:

FIG. 6A is an enlarged view of the encircled area of FIG. 6, illustrating a pair of interfacing enhancements;

FIG. 6B is an enlarged fragmentary view of a second embodiment heat exchanger according to the present invention, showing a pair of enhancements;

FIG. 6C is an enlarged fragmentary view of a third embodiment heat exchanger according to the present invention, showing a pair of interfacing enhancements;

FIG. 7 is a sectional view of the heat exchanger element of FIG. 3 taken along line 7—7;

FIG. 8 is an end view of the heat exchanger element of FIG. 3 viewed along line 8—8;

Figure 1:
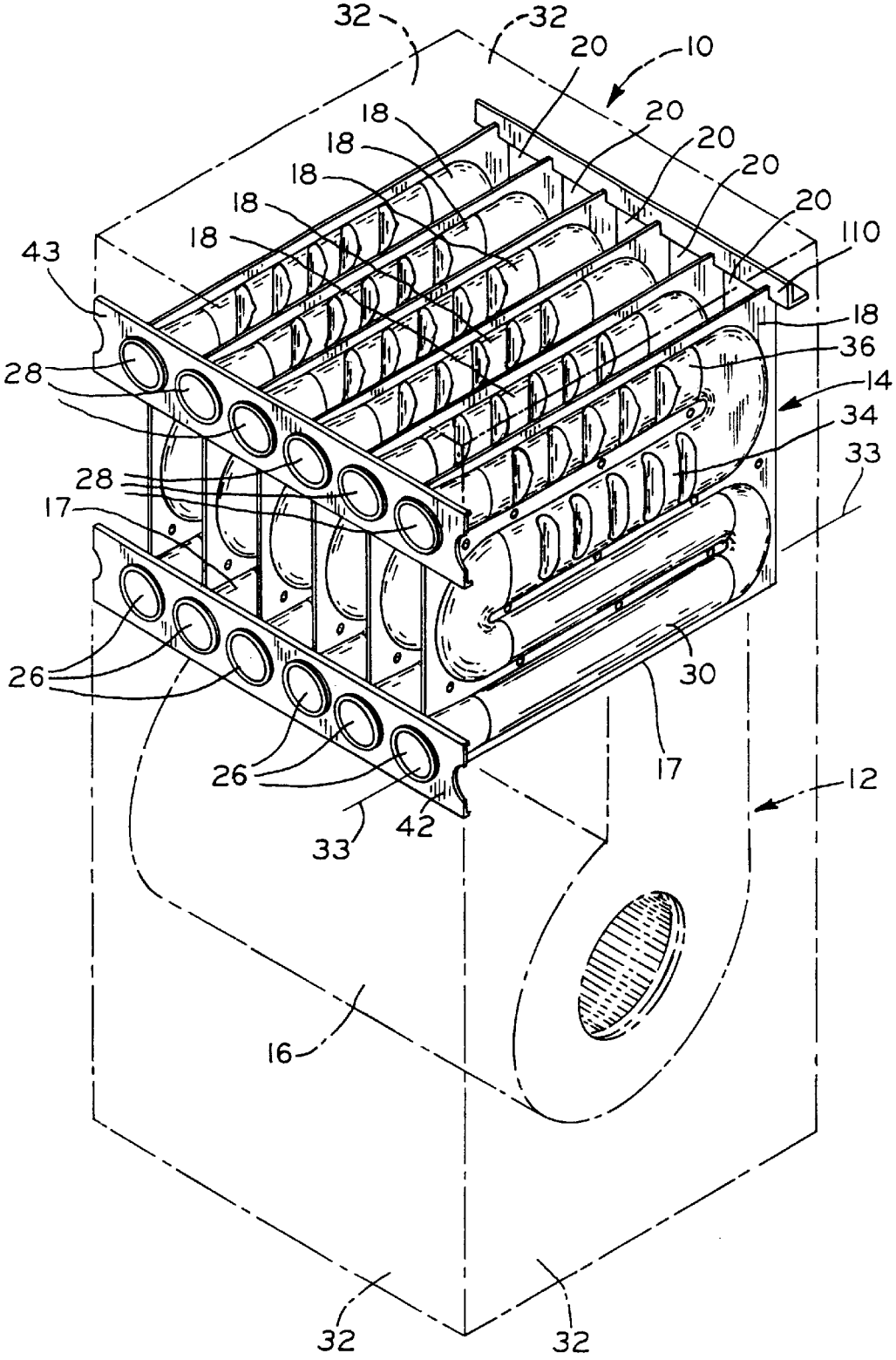
FIG. 1 is a perspective view of a furnace adapted with a plurality of heat exchanger elements according to the present invention showing the heat transfer enhancements thereon.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention, and such exemplifications are not to be construed as being exhaustive or to limit the scope of the invention in any manner.

DETAILED DESCRIPTION OF THE INVENTION

Referring to FIG. 1, furnace 10 is shown including outer housing, or cabinet 12. Mounted within cabinet 12 is heat exchanger bank generally designated 14. Air to be conditioned, hereinafter referred to as room air, is delivered to heat exchanger bank 14 by blower 16. Heat exchanger bank 14 is defined by a plurality of side-by-side heat exchanger elements 18 providing therebetween a plurality of air flow passages 20 for passing air delivered from blower 16 in heat transfer association with each heat exchanger element 18. Hot products of combustion or flue gases are flowed through the interiors of heat exchanger elements 18 from a burner means (not shown) having a plurality of individual burners (not shown) and each burner is associated with a respective heat exchanger element 18. The products of combustion from the respective heat exchanger elements are forcibly exhausted by an exhaust blower (not shown), for example, from the furnace through a discharge flue (not shown) by known means.

Blower 16 is adjacently disposed relative to horizontal divider wall 17 so as to deliver the air to be conditioned upwardly through an inlet opening (not shown) in divider wall 17 which thereafter communicates with heat exchanger flow passages 20. After passing in external heat exchange relationship with the heat exchanger elements 18, the heated air is conducted to the space to be heated by suitable duct means (not shown). Subsequently, the room air may be recirculated through the furnace by suitable return ducts (not shown) to blower 16.

Figure 2:
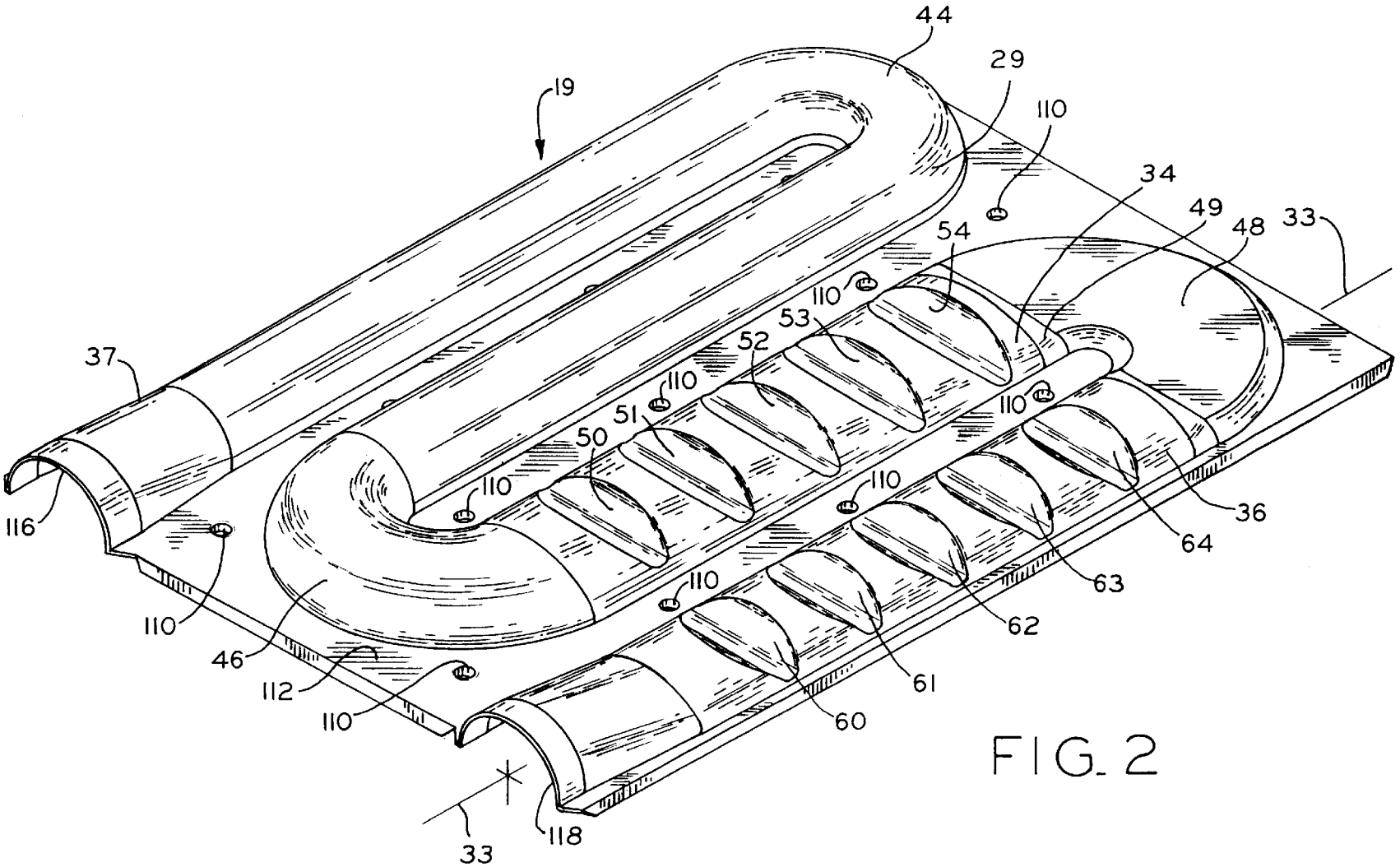
FIG. 2 is a perspective view of a first embodiment of a right-hand half section of the heat exchanger with enhancements according to the present invention.
Figure 3:
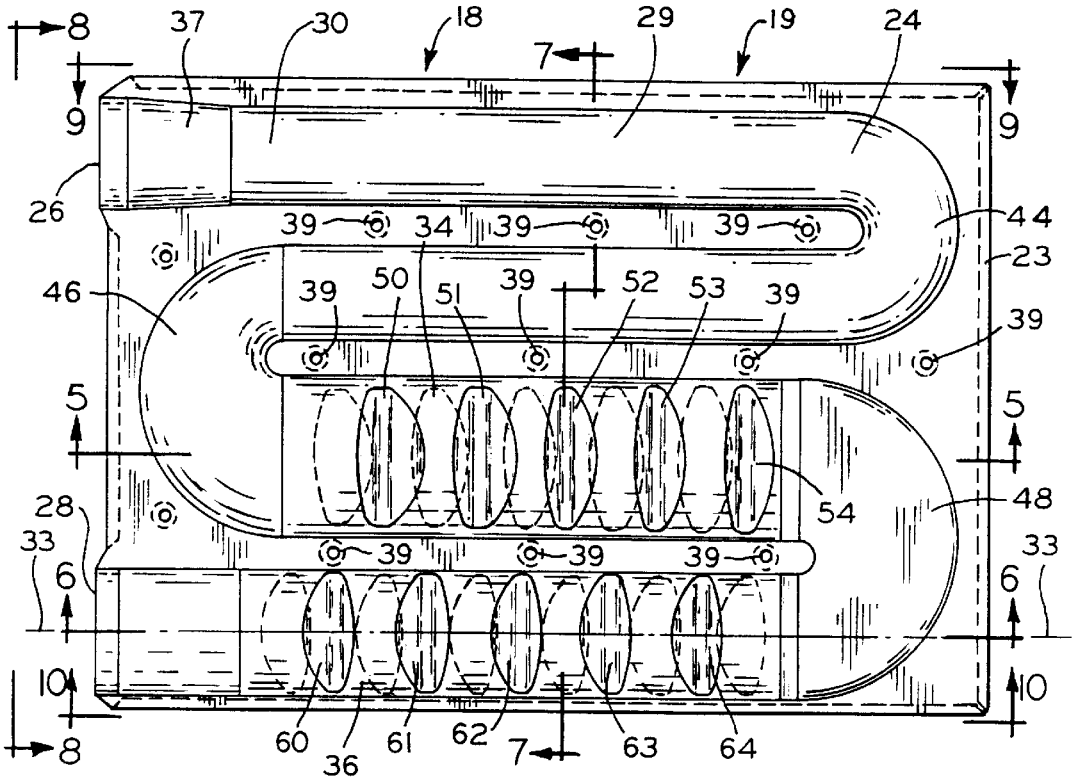
FIG. 3 is a plan view of one of the heat exchanger elements of the heat exchanger element of FIG. 1, showing the right-hand half section.
Figure 4:
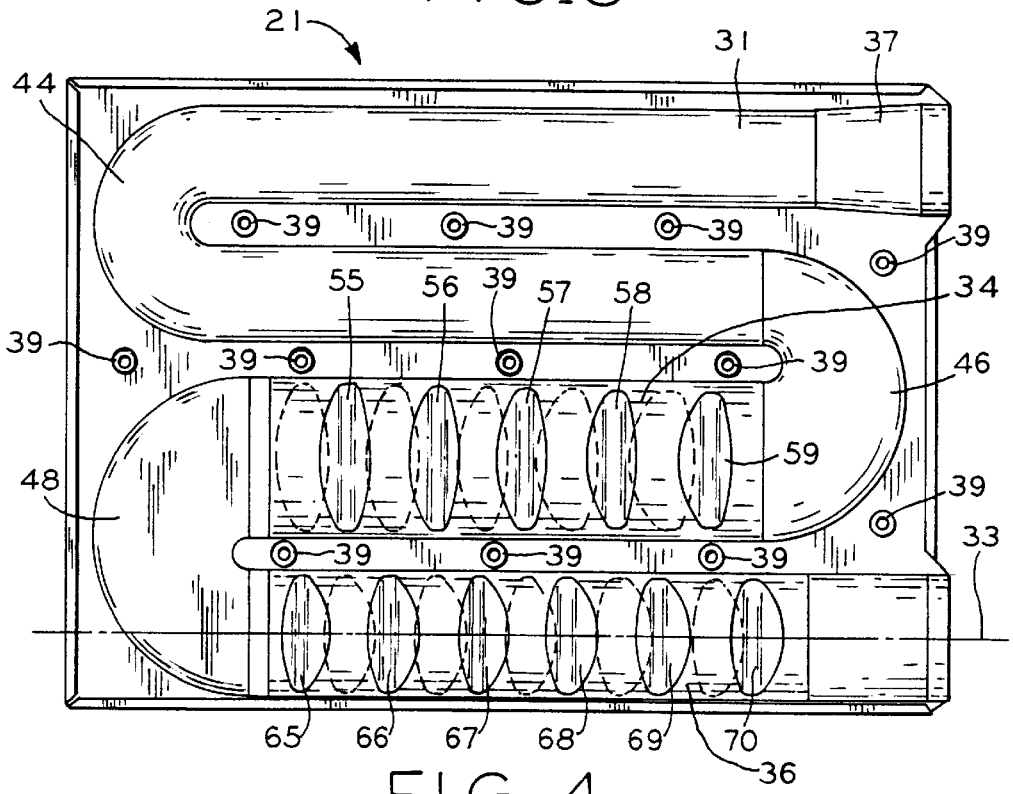
FIG. 4 is a plan view of the heat exchanger element of FIG. 3, showing the left-hand half section.
Figure 5:
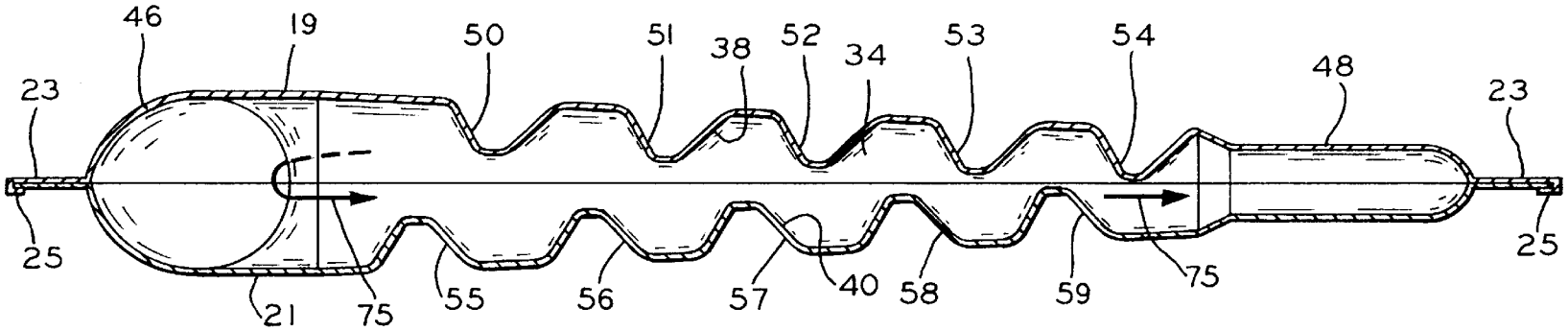
FIG. 5 is a sectional view of the heat exchanger according to the present invention taken along line 5—5 of FIG. 3, showing a first enhancement channel.

Referring to FIGS. 2–4, each heat exchanger element 18 is formed by preforming a pair of individual plates or "clamshells." Each element includes right-hand clamshell 19 (FIGS. 1–3) and left-hand clamshell 21 (FIG. 4). Clamshells 19 and 21 include depressions 29, 31 forming the serpentine configuration illustrated in FIGS. 2–4, having peripheral edge 23 of heat exchanger element 18 secured together in sealed relationship by a turned end portion or crimp 25 (FIG. 5). The crimped engagement of clamshells 19 and 21 is the subject of U.S. Pat. Nos. 4,298,061; 4,441,241; 4,510,660; 4,538,338; 4,547,943; 4,649,894; 4,663,837; 4,718,484; and 4,893,390 and are hereby incorporated herein by reference. Referring to FIGS. 3–4, it may be seen that eyelets 39 are arranged about inner portions of clamshells 19, 21 specifically along passageway 24, to prevent combustion products from escaping through the interior of clamshells 19, 21. Each eyelet 39 is comprised of material from one clamshell protruding through a hole extended through the other clamshell (FIG. 7). The material protruding through is then "rolled over" to produce a secure engagement between clamshells. Clamshells 19 and 21 of heat exchanger element 18 may be comprised of corrosion resistant metallic materials, such as aluminized steel, stainless steel, or a coated metal material, for example.

Referring to FIGS. 1–4, each pair of depressions 29, 31 of heat exchanger element 18 defines a serpentine products of combustion passageway 24, formed by passageway walls 27 (FIG. 6A), having an inlet 26 and an outlet 28. Referring to FIG. 3, the hot products of combustion received from the respective burners enter passageway 24 through inlet 26. Serpentine fluid passageway 24 includes an inlet channel 30 which is U-shaped and extends in a direction coincident with longitudinal reference axis 33. Inlet channel 30 is transversely arranged relative to air flow passages 20 defined between the respective heat exchanger elements 18 and walls 32 comprising cabinet 12 (FIGS. 1 and 2). As best seen in FIG. 3, each heat exchanger element 18 includes two enhanced heat transfer channels, namely, first enhancement channel 34 and second enhancement channel 36. Channels 30, 34, and 36 longitudinally extend along longitudinal axis 33 and are generally parallel to each other. Further, it may be seen that enhancement channels 34 and 36 are perpendicularly arranged relative to the direction of air flow from blower 16 (FIG. 1).

Referring to FIG. 3, serpentine fluid passageway 24 is formed from an interfaced relation between depression 29 of clamshell 19 and depression 31 of matching clamshell 21. Depressions 29, 31 define inlet 26, outlet 28, and passageway 24 extended therebetween. Passageway 24 fluidly connects inlet and outlet 26 and 28. Inlet and outlet manifolds 42, 43 (FIG. 1) are attached to respective inlets and outlets 26, 28 of heat exchanger elements 18 to accommodate connection to a burner assembly (not shown) and an exhaust blower assembly (not shown).

Figure 6:
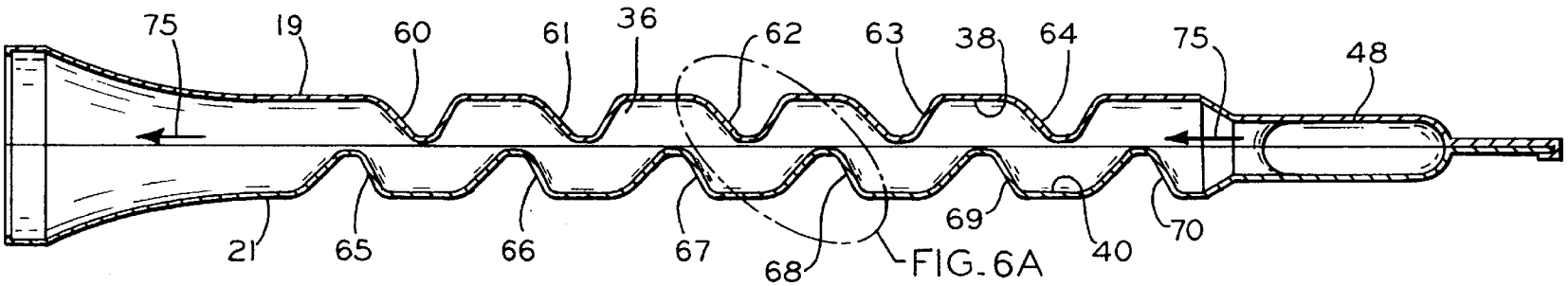
FIG. 6 is a sectional view of the first embodiment heat exchanger according to the present invention taken along line 6—6 of FIG. 3, showing the enhancements within a second enhancement channel.
Figure 9:
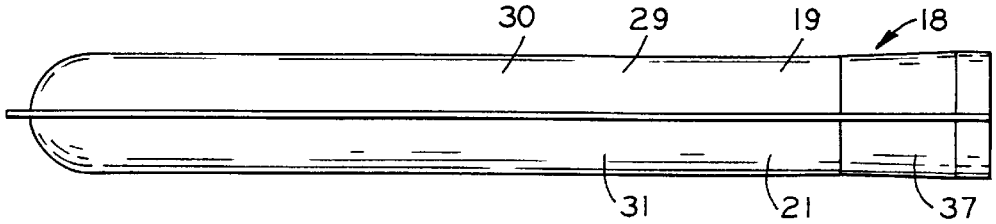
FIG. 9 is a top view of the heat exchanger element of FIG. 3 viewed along line 9—9.
Figure 10:
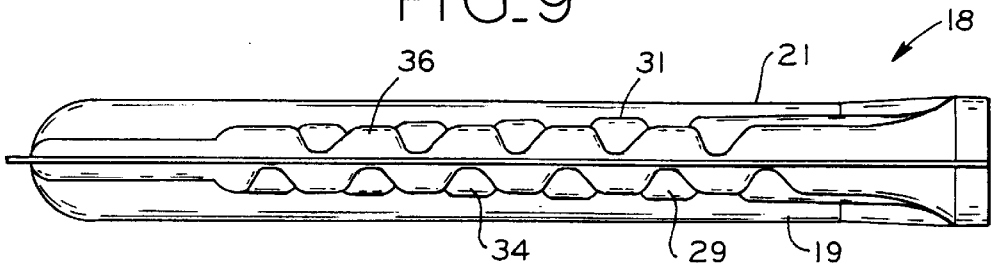
FIG. 10 is a bottom view of the heat exchanger element of FIG. 3 viewed along line 10—10.

Attached to inlet manifold 42 (FIG. 1) is inlet channel 30 provided with U-shaped bend 44 at peripheral edge 23 of heat exchanger element 18. Inlet channel 30, generally circular in cross-section (FIG. 7), is provided with a converging nozzle portion 37 (FIG. 2) and is connected to first enhancement channel 34 through U-shaped bend 46 (FIG. 5). Bend 46, transitions from a generally circular cross-section at its connection with inlet channel 30, to a non-circular cross-section 35 (FIGS. 7–8) as it merges into first enhancement channel 34. Referring to FIG. 2, first enhancement channel 34 becomes increasingly flat and connects with flat U-shaped bend 48 through reduction connector 49 (FIG. 2). Bend 48 is substantially uniformly flat and connects first and second enhancement channels 34, 36 (FIGS. 5–6). Flat bend 48 provides a decreased flow area corresponding to an increase in velocity of flow of hot products of combustion in preparation for urging the flow through second enhancement channel 36. In the exemplary embodiment, the "flatness" or reduction in height of first enhancement channel 34 may be 5.9 mm over a 275.4 mm length, for example.

Referring to FIGS. 1–4, serpentine fluid passageway 24 includes trapezoidally shaped, spaced corrugations or enhancements transversely arranged relative to longitudinal reference axis 33, provided on first and second enhancement channel portions 34, 36, respectively. First enhancement channel portion 34 includes enhancements 50–54 (FIG. 3) formed on clamshell 19 internested or staggered with enhancements 55–59 (FIG. 4) formed on clamshell 21. The staggered relationship is best seen in FIG. 5 as the alternating enhancements form a generally saw-toothed passageway for hot products of combustion to turbulently flow therethrough. Similarly, second enhancement channel 36 includes enhancements 60–64 (FIG. 3), formed in clamshell 19, in an internested relationship with enhancements 65–69 (FIG. 4) formed in clamshell 21, to provoke flow turbulence and increased heat transfer. In contrast to first enhancement channel 34 illustrated in FIG. 5, passageway walls 27 (FIG. 6) of second enhancement channel 36 do not taper and are generally uniformly spaced relative to the space formed between clamshells 19, 21.

Referring to FIG. 6A, second enhancement channel 36 of the first embodiment heat exchanger 18 is shown, illustrating asymmetrically arranged enhancements 62 and 68. Specifically, second enhancement channel 36 includes enhancement 68 having upstream ramp 71 and downstream ramp 72 respectively positioned at angles of inclination and declination $\alpha$ and $\theta$ measured relative to longitudinal reference line 74. Arrow 75 illustrates the direction of flow for the hot products of combustion flowing therethrough (FIGS. 5 and 6). Further, it may be seen that located between wall 27 of passageway 24 and ramp 71 is arced intersection 76. Plateau 78 is provided between ramps 71 and 72 and a pair of rounded edges 80, 82 are provided at the intersection of plateau 78 and respective ramps 71, 72. Additionally, arced intersection 84, positioned downstream relative to engagement portion 68, is provided between the intersection of ramp 72 and passageway wall 27.

In the exemplary embodiment, upstream and downstream ramps 71 and 72 may have angles of inclination and declination of $\alpha$ and $\theta$ of 63° and 47°, respectively. Further, rounded edges 80, 82 may each include an inside radius of 6.9 mm and arced intersections 76 and 84 may have respective inside radii of 7.6 mm and 15.2 mm. Accordingly, each raised enhancement may extend into passageway 24 depth "D" of 14 mm, for example.

Referring to FIGS. 6 and 6A, enhancement 62 is generally a mirror image of enhancement 68, however enhancement 62 is arranged offset, relative to enhancement 68. In the exemplary embodiment substantially all of the enhancements are of similar construction and include each upstream ramp 71 positioned upstream of each counterpart downstream ramp 72 (FIG. 6A). However, an infinite selection of ramp angles and enhancement contours are possible which may be common or differ between individual enhancements to provide enhanced heat transfer characteristics.

Referring to FIGS. 6B and 6C, shown are additional exemplary embodiments of the present invention which also provide enhanced heat transfer characteristics between hot products of combustion and room air. Specifically, and with reference to FIG. 6B, shown is a second embodiment heat exchanger including second enhancement channel 36*b* of heat exchanger element 18*b*. Heat exchanger element 18*b* includes a similar number and spacing of enhancements as compared to heat exchanger 18, however differs therefrom in several aspects. One such difference corresponds to enhancement 68*b* which includes upstream and downstream ramps 71*b*, 72*b*, provided with respective angles $\alpha_b$ and $\theta_b$, measured from longitudinal reference line 74*b*. Angles $\alpha_b$ and $\theta_b$ are substantially similar. Yet, it may be seen that enhancement 68*b* is asymmetrical due to arced intersection 84*b* having a significantly larger radius relative to arced intersection 76*b*. For example, angles $\alpha_b$ and $\theta_b$, may each be 63° and arced intersections 76*b* and 84*b* may have 4.6 mm and 15.2 mm inside radii, respectively. Rounded edges 80*b*, 82*b* may each be provided with a 4.6 mm inside radius and depth $D_b$ of enhancements 62*b*, 68*b* may be 16.3 mm, for example.

Referring to FIG. 6C, shown is a third embodiment heat exchanger provided with enhancements 62*c*, 68*c* within second enhancement channel 36*c* of heat exchanger element 18*c*. Enhancement 68*c* differs from enhancement 68 in that it is symmetrically arranged and angles $\alpha_c$ and $\theta_c$ of ramps 71*c*, 72*c* are substantially identical. Also, it may be seen that arced intersection 76*c* is substantially similar to that of arced intersection 84*c*. For example, angles $\alpha_c$ and $\theta_c$ may each be 63°, arced intersections 76*c* and 84*c* each may include an inside radius of 3.8 mm and rounded edges 80*c*, 82*c* may be 4.6 mm measured at their respective inside radii. Further, enhancements 62*c*, 68*c* may include depth $D_c$ of 16.3 mm, for example.

Figure 11:
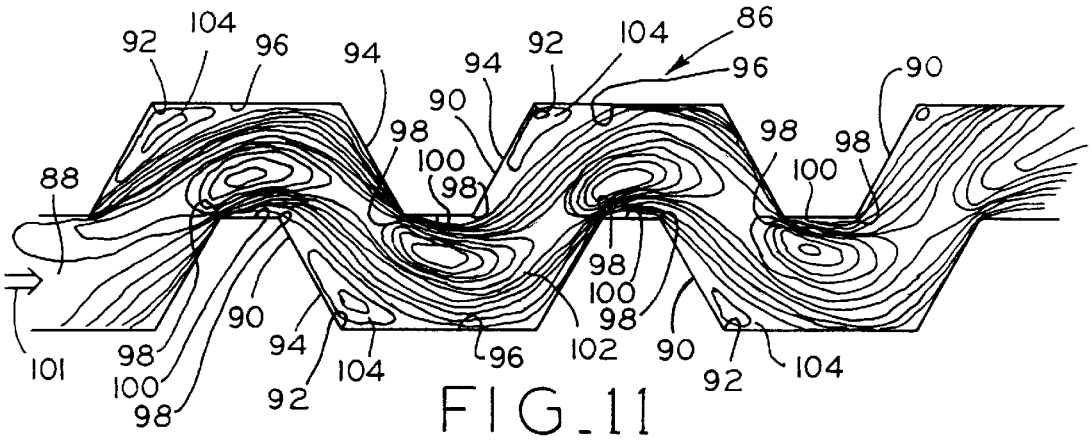
FIG. 11 is a flow model of a heat exchanger having angled symmetrical enhancements, showing the stream-line contours of the hot products of combustion flowing therethrough.

Referring to FIG. 11, shown is a first flow model with uniform and sharply formed enhancements 90. Passageway 88 accommodates the flow of hot products of combustion which are illustrated by flow arrow 101 and flow streamline contour 102. First flow model 86 does not directly correspond to any of the described embodiments of heat exchangers of the present invention, however the disclosure of its structure and function is fundamental to understanding the operation of the exemplary embodiments of the inventive heat exchangers according to the present invention. Flow model 86 includes uniform enhancements 90 which are intersected to form generally saw-toothed shaped passageway 88 therebetween. First flow model 86 includes intersections 92 formed between each ramp 94 and adjacently positioned wall portion 96. Each enhancement 90 includes a pair of edge portions 98 separated by a generally planar plateau portion 100. It may be seen that the hot products of combustion flowing through passageway 88, indicated by arrow 101, form flow streamline contour 102. Streamline contour 102 represents a velocity gradient of flow through passageway 88 wherein an increased number of lines represents an increased flow velocity. Those having ordinary skill in the art will appreciate that increased velocity of the combustion products is directly related to increased heat transfer. Proximate to edge portions 98, contour 102 illustrates an increased velocity region. In contrast, proximate to the intersections 92 the velocity is generally insignificant shown by a lack of streamlines, and moreover this deficiency of streamlines corresponds to "recirculation zones" 104. Recirculation zones 104 represent flow stagnation corresponding to low flow velocity and insignificant heat transfer.

Figure 12:
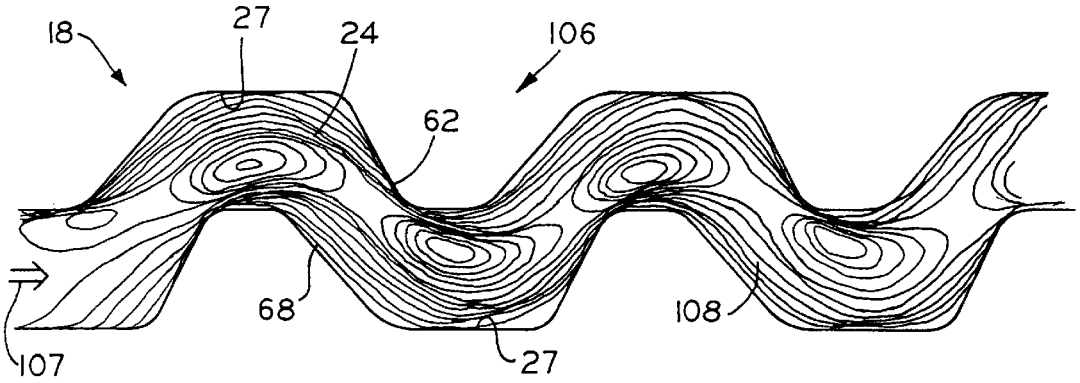
FIG. 12 is a flow model of the first embodiment heat exchanger according to the present invention, showing the stream line contours of the hot products of combustion flowing therethrough.

Referring to FIG. 12, shown is second flow model 106 which corresponds to the first embodiment heat exchanger 18 according to the present invention. In contrast to flow model 86 shown in FIG. 11, second flow model 106 illustrates a flow of hot products of combustion indicated by flow by arrow 107, forming streamline curve 108 having little or no recirculation zones. Flow streamline curve 108 in FIG. 12 discloses a generous number of streamlines in close proximity to passageway walls 27 corresponding to increased flow velocity and enhanced heat transfer between the hot products of combustion flowing through passageway 24 and room air circulating over external surfaces of passageway walls 27. Similarly, the second and third embodiment heat exchangers include respective heat exchanger elements 18*b*, 18*c* exhibiting substantially similar flow performance and heat transfer characteristics to that of flow contour 108 of FIG. 12.

Figure 14:
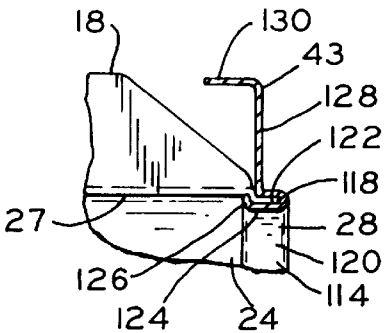
FIG. 14 is an enlarged fragmentary sectional view of the heat exchanger according to the present invention, viewed along line 14—14 of FIG. 13.
Figure 13:
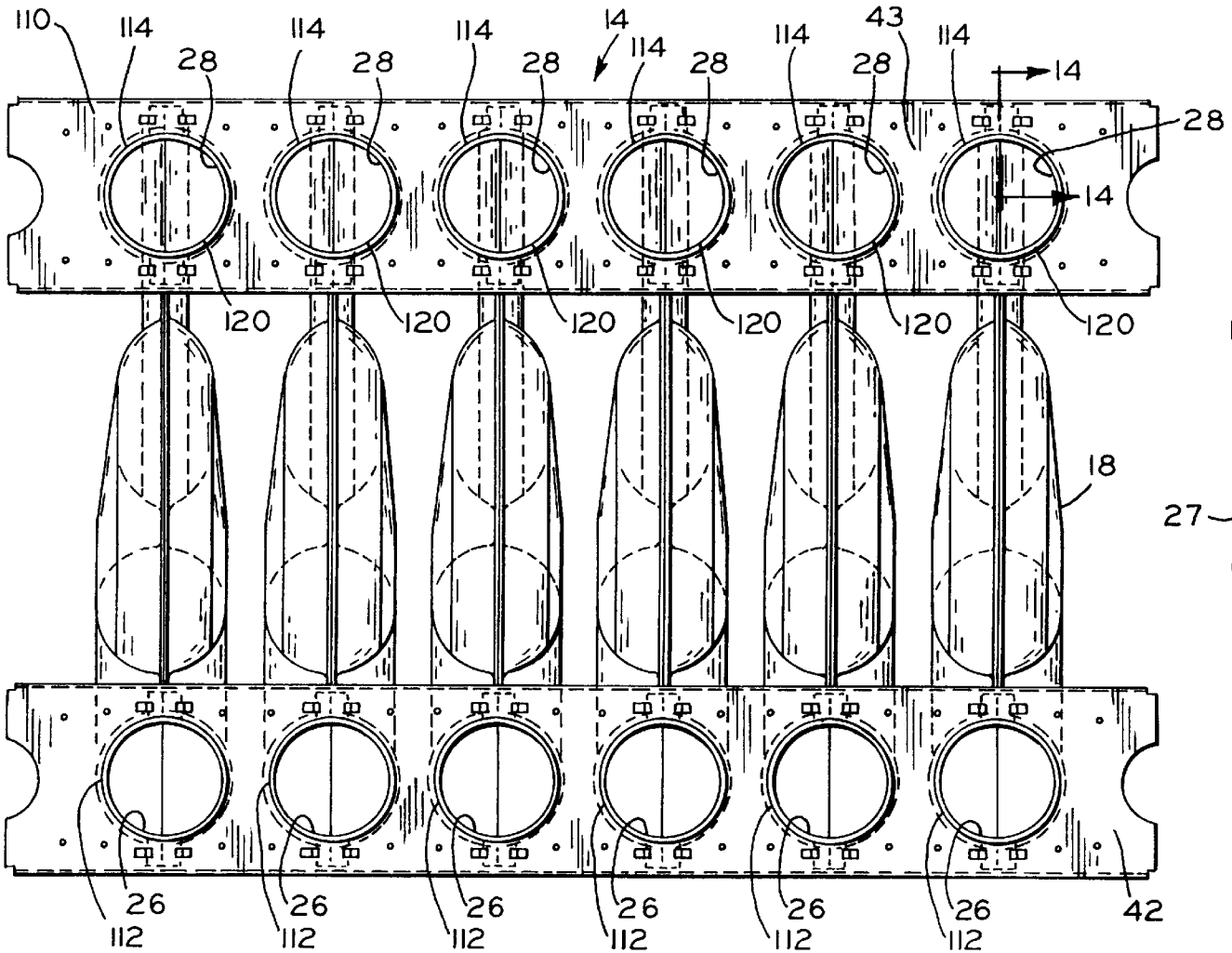
FIG. 13 is a plan view of the heat exchanger bank according to the present invention, showing the inlet and outlet ports.

Referring to FIGS. 1 and 13, arrangement of the heat exchanger elements to form a heat exchanger or bank 14 will now be described. As best seen in FIG. 13, each heat exchanger element 18 is supported by being attached to inlet manifold 42, outlet manifold 43 and L-shaped support member 110 (FIG. 1). The distance between any two adjacent each heat exchanger elements is predetermined by the spacing of inlet holes 112, in inlet manifold 42, and outlet holes 114, in outlet manifold 43 (FIG. 13). Each heat exchanger element 18 includes an annular inlet rim 116 (FIG. 2) and outlet rim 118 (FIG. 2), which respectively attach to inlet and outlet manifolds 42, 43. Each outlet rim 118, as best illustrated in FIG. 14, is sealingly attached to outlet manifold 43 utilizing a crimping relationship to form a gas-tight seal therebetween. U-shaped sleeve 120, which includes slot 122, is engaged by annular protrusion 124 provided by heat exchanger element 18. Sleeve 120 extends into passageway 24 of heat exchanger element 18 and is bent over at bend 126 to sealably join outlet manifold 43 with heat exchanger element 18. Outlet manifold 43 includes flange portion 128 extended radially, outwardly from each outlet hole 114 and includes a perpendicular bend 130, to provide access for the exhaust fan assembly (not shown). It will be understood that the sealed engagement of inlet manifold 42 with each heat exchanger 18 is similar to the sealed engagement of outlet manifold 43 with each heat exchanger 18 previously described.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A heat exchanger for use with a furnace, said heat exchanger comprising:

a plurality of heat exchanger elements, each said heat exchanger element including a pair of clamshells sealingly attached to one another, each said heat exchanger element having a longitudinal axis, a pair of depressions disposed in each respective said pair of clamshells, said depressions facing one another to form a passageway wall and a serpentine fluid passageway therebetween, at least a portion of said serpentine fluid passageway extending along said longitudinal axis, a plurality of enhancements in said depressions and disposed within said portion of said serpentine fluid passageway, said plurality of enhancements projecting into said serpentine fluid passageway, each said enhancement comprising a transversely extending corrugation having a substantially trapezoidal longitudinal cross-section, a longitudinally positioned passageway wall portion extending between adjacently positioned enhancements within each clamshell, at least one enhancement channel defined by a portion of said serpentine passageway, said enhancement channel including said corrugations, said corrugations disposed one of said pair of depressions including ramping surfaces in fluid communication with ramping surfaces defined by the corrugations disposed on the other depression, each of said ramping surfaces including an angle of inclination followed by an angle of declination, said angle of inclination greater than said angle of declination, said plurality of enhancements structured and arranged with said passageway wall portions to direct a flow of products of combustion received in said heat exchanger element along said serpentine fluid passageway wall at a non-zero velocity, whereby a flow velocity of hot products of combustion is registerable through substantially said entire enhancement channel at positions proximate to said ramping surfaces.

2. The heat exchanger of claim 1, wherein said serpentine fluid passageway includes an inlet and an outlet and a plurality of longitudinally arranged channels fluidly connecting said inlet and said outlet, said channels fluidly connected by bend portions.

3. The heat exchanger of claim 1, further comprising a first manifold wherein said each heat exchanger element is fixed relative to an adjoining said heat exchanger element through said first manifold.

4. The heat exchanger of claim 3, further comprising a second manifold, said first manifold is attached to either said inlets or outlets of said serpentine passageway and said second manifold is attached to the remaining of said inlets or outlets.

5. The heat exchanger of claim 3, further comprising a support member attached to a periphery portion of each said heat exchanger element.

6. The heat exchanger of claim 1, wherein said corrugations on one of said pair of clamshells are offset and interested relative to the other corrugations of the other said clamshell to form a continuous saw-toothed passageway disposed in said portion of said longitudinally arranged serpentine fluid passageway.

7. The heat exchanger of claim 6 wherein said saw-toothed passageway includes a substantially uniform longitudinal cross-section.

8. The heat exchanger of claim 6, wherein said saw-toothed passageway tapers longitudinally in the direction of the flow through said serpentine fluid passageway.

9. A heat exchanger element for use with a furnace, said heat exchanger element comprising:

a pair of clamshells sealingly attached to one another, said heat exchanger element having a longitudinal axis, a pair of depressions disposed in said pair of clamshells, said depressions facing one another to form a passageway wall and a serpentine fluid passageway therebetween, at least a portion of said serpentine fluid passageway extending along said longitudinal axis, a plurality of enhancements in said depressions and disposed within said portion of said serpentine fluid passageway, said plurality of enhancements projecting into said serpentine fluid passageway, each said enhancement comprising a corrugation having a substantially trapezoidal longitudinal cross-section, a longitudinally positioned passageway wall portion extending between each adjacently positioned enhancements within each clamshell, at least one enhancement channel defined by a portion if said serpentine passageway, said enhancement channel including said corrugations, said corrugations disposed on one of said pair of depressions including ramping surfaces in fluid communication with ramping surfaces defined by the corrugations disposed on the other depression, each of said ramping surfaces including an angle of inclination followed by an angle of declination, said angle of inclination greater than said angle of declination, said plurality of enhancements structured and arranged with said passageway wall portions to direct a flow of products of combustion received in said heat exchanger element along said serpentine fluid passageway wall at a non-zero velocity, whereby a flow velocity of hot products of combustion is registerable through substantially said entire enhancement channel at positions proximate to said ramping surfaces.

10. The heat exchanger element of claim 9, wherein one of said pair of depressions includes said corrugations being internested with the other said corrugations on the other said depression.

11. A heat exchanger for use with a furnace, said heat exchanger including at least one heat exchanger element which receives hot products of combustion therein and having room air being forced externally thereover, the heat exchanger element comprising:

a pair of clamshells each having a depression disposed therein and sealingly attached to one another, said depressions defining an inlet and an outlet in fluid communication through a serpentine flow passageway, a portion of said flow passageway defining an inlet channel, at least one enhancement channel disposed in said flow passageway and positioned downstream relative to said inlet channel, a plurality of enhancements provided on said depressions and extended inwardly into said enhancement channel, each said enhancement comprising a transversely extending corrugation having a substantially trapezoidal longitudinal cross-section, a longitudinally positioned passageway wall portion extending between adjacently position enhancement within each clamshell, said enhancements reducing zones of recirculation of the hot products of combustion flowed internally through said flow passageway, said flow passageway including an inlet channel, a first enhancement channel and a second enhancement channel, said first and second enhancement channels defined by a portion of said serpentine passageway, said enhancements confined to said first and second enhancement channels, said first and second enhancement channels including said corrugations, said corrugations disposed on one of said pair of depressions including ramping surfaces in fluid communication with ramping surfaces defined by the corrugations disposed on the other depression, each of said ramping surfaces including an angle of inclination followed by an angle of declination, said angle of inclination greater than said angle of declination, said first and second enhancement channels extending longitudinally, said enhancements transversely disposed within said first and second enhancement channels, said first enhancement channel tapering longitudinally in the direction of internal flow, said second enhancement channel substantially longitudinally uniform, whereby heat transfer is increased between the hot products of combustion and room air urged externally over said at least one heat exchanger element.

12. A heat exchanger element for use with a furnace, each heat exchanger element comprising:

a pair of clamshells sealingly attached to one another, said heat exchanger element having a longitudinal axis, a pair of depressions disposed in said pair of clamshells, said depressions facing one another to form a passageway wall and a serpentine fluid passageway therebetween, at least a portion of said serpentine fluid passageway extending along said longitudinal axis, a plurality of enhancements in said depressions and disposed within said portion of said serpentine fluid passageway, said plurality of enhancements projecting into said serpentine fluid passageway, each said enhancement comprising a corrugation having a substantially trapezoidal longitudinal cross-section, a longitudinally positioned passageway wall portion extending between each adjacently positioned enhancements within each clamshell, said serpentine fluid passageway including an inlet channel, a first enhancement channel and a second enhancement channel, said corrugations confined to said first and second enhancement channels, said first and second enhancement channels extending longitudinally, said corrugations transversely disposed within said first and second enhancement channels, said first enhancement channel tapering longitudinally in the direction of internal flow, said second enhancement channel substantially longitudinally uniform, said plurality of enhancements structured and arranged with said passageway wall portions to direct a flow of products of combustion received in said heat exchanger element along said serpentine fluid passageway wall at a non-zero velocity.

* * * * *